US012584695B2

(12) United States Patent
Xiong et al.

(10) Patent No.: US 12,584,695 B2
(45) Date of Patent: Mar. 24, 2026

(54) COMBINATION THERMAL MODULE AND WICK STRUCTURE THEREOF

(71) Applicant: ASIA VITAL COMPONENTS (CHINA) CO., LTD., Shenzhen (CN)

(72) Inventors: Xiwen Xiong, Shenzhen (CN); Xingxing Lyu, Shenzhen (CN); Wei Liu, Shenzhen (CN); Lei Yao, Shenzhen (CN)

(73) Assignee: ASIA VITAL COMPONENTS (CHINA) CO., LTD., Shenzhen (CN)

( * ) Notice: Subject to any disclaimer, the term of this patent is extended or adjusted under 35 U.S.C. 154(b) by 141 days.

(21) Appl. No.: 18/387,855

(22) Filed: Nov. 8, 2023

(65) Prior Publication Data

US 2025/0146763 A1 May 8, 2025

(51) Int. Cl.
*F28D 15/04* (2006.01)

(52) U.S. Cl.
CPC ..... *F28D 15/04* (2013.01)

(58) Field of Classification Search
CPC ..... F28D 15/04
See application file for complete search history.

(56) References Cited

U.S. PATENT DOCUMENTS

2016/0003555 A1* 1/2016 Sun ..... F28D 15/046 165/104.26
2019/0049190 A1* 2/2019 Liu ..... F28F 1/325

FOREIGN PATENT DOCUMENTS

| | | | |
|---|---|---|---|
| CN | 218634645 | U | 3/2023 |
| TW | 201728865 | A | 8/2017 |
| TW | M630475 | U | 8/2022 |
| TW | M650614 | U | 1/2024 |

OTHER PUBLICATIONS

Search Report dated Sep. 3, 2024 issued by Taiwan Intellectual Property Office for counterpart application No. 112140198.

* cited by examiner

*Primary Examiner* — Jianying C Atkisson
*Assistant Examiner* — Khaled Ahmed Ali Al Samiri
(74) *Attorney, Agent, or Firm* — Demian K. Jackson; Jackson IPG PLLC

(57) ABSTRACT

A combination thermal module includes a vapor chamber defining an airtight chamber filled with a working fluid and having at least one through hole formed thereon communicable with the airtight chamber; at least one annular wick structure provided in the airtight chamber corresponding to the through hole; and at least one heat pipe has an open end inserted into the airtight chamber to contact with a first wick structure on an inner lower surface of the vapor chamber and be axially supported on the annular wick structure. The annular wick structure includes communicable axial and radial passages, allowing vaporized working fluid to flow from the vapor chamber to the heat pipe quickly. With these arrangements, the thermal module has a shortened flow-back path between the vapor chamber and the heat pipe to avoid dry burning in the vapor chamber and upgrade the two-phase heat exchange efficiency of the vapor chamber.

11 Claims, 5 Drawing Sheets

COMBINATION THERMAL MODULE AND WICK STRUCTURE THEREOF

FIELD OF THE INVENTION

The present invention relates to a combination thermal module, and more particularly, to a combination thermal module that has enhanced structural strength and allows a working fluid to flow back from a condensing zone to a vaporizing zone more efficiently. The present invention also relates to a wick structure of the above mentioned combination thermal module.

BACKGROUND OF THE INVENTION

To satisfy customers' increasing demands for good heat dissipation of electronic devices, such as computers or servers, a three-dimensional (3D) vapor chamber (VC) has been developed. Compared to a conventional two-dimensional (2D) vapor chamber, the 3D vapor chamber advantageously has higher density of integration, higher vapor diffusion rate, smaller thermal resistance, and higher upper limit of heat dissipation. In view of the constantly increased density of integration of chips in the electronic devices and the increasing requirement for heat dissipation, the conventional heat pipe and/or vapor chamber can no longer suffice the heat dissipation requirement for the high heat flux electronics, the 3D vapor chamber has been widely applied in the field of electronic device heat dissipation and gradually replaces the heat pipe and/or the vapor chamber used individually.

Please refer to FIG. 1 that is a cross-sectional view of a conventional 3D vapor chamber structure 1. As shown, the conventional 3D vapor chamber structure 1 consists of a plurality of pipes 11 and a vapor chamber 12. The vapor chamber 12 includes an upper plate member 121 and a lower plane member 122, which are closed to each other to define a chamber 124 between them. The chamber 124 has a working fluid (not shown) filled therein. The upper plate member 121 is provided with at least one opening 123, which extends through the upper plate member 121 to communicate with the chamber 124. The opening 123 has a rim that extends upward to form a ring-shaped neck portion 123*a*. A first wick structure 125 and a second wick structure 126 are provided on an inner wall surface of the upper and the lower plate member 121, 122, respectively. And, a plurality of supporting members 127 is provided in the chamber 124 to support and space the upper and the lower plate member 121, 122 from one another. The supporting members 127 and the openings 123 are arranged in a staggered manner to space from one another.

The pipe 11 has two ends, one of which is a closed end 111 and the other is an open end 112. The pipe 11 internally defines a tubular chamber 114 between the closed end 111 and the open end 112. The open end 112 of the pipe 11 is inserted through the opening 123 to connect with the upper plate member 121; and a joint between the ring-shaped neck portion 123*a* of the opening 123 on the upper plate member 121 and the open end 112 of the pipe 11 is fixedly connected together by welding. The tubular chamber 114 in the pipe 11 is communicable with the chamber 124 via the open end 112 of the pipe 11. And, a third wick structure 115 is provided on an inner wall surface of the tubular chamber 114.

The third wick structure 115 in the pipe 11 can be distributed to contact with or without contacting with the first wick structure 125 in the vapor chamber 12 on the inner wall surface of the upper plate member 121.

The working fluid condensed in the pipe 11 can flow back from the closed end 111 to a vaporizing zone in the vapor chamber 12 in two ways. In the first way, the condensed working fluid in the pipe 11 flows through the open end 112 of the pipe 11 to the first wick structure 125 nearby the opening 123 on the upper plate member 121 and is then collected at the first wick structure 125. When the collected working fluid reaches a predetermined volume, it drops into the vaporizing zone due to gravity. In the second way, the working fluid flows back to places near the opening 123 and is diffused and spread horizontally with the aid of the first wick structure 125. When the diffused working fluid meets the supporting members 127, it flows downward along outer surfaces of the supporting members 127 and reaches at the second wick structure 126, from where the working fluid flows back to the vaporizing zone in the vapor chamber 12. Since the supporting members 127 are located at a distance from the opening 123, the working fluid has to flow through a considerably long path before it reaches at the vaporizing zone, resulting in low flow-back efficiency. In the case the time and the path for the working fluid to flow back to the vaporizing zone are very long and the working fluid could not flow back to the vaporizing zone in time, the vaporizing zone tends to occur dry burning due to insufficient working fluid therein.

Further, the pipe 11 and the vapor chamber 12 are horizontally fixedly welded to each other only at the joint between the ring-shaped neck portion 123*a* and the open end 112. That is, the pipe 11 and the vapor chamber 12 only have a line contact formed between them. The pipe 11 extended into the chamber 124 in the vapor chamber 12 is not vertically supported or held in place by any structure. When the pipe 11 is subjected to a vertical impact, or when the closed end 111 of the pipe 11 has radiation fins mounted thereon, it is very possible that the pipe 11 would separate from the vapor chamber 12 or become bent or even broken to cause leakage of the working fluid from the conventional 3D vapor chamber 1. The above problems in the conventional 3D vapor chamber 1 must be solved as soon as possible.

SUMMARY OF THE INVENTION

To effectively solve the problems in the prior art, it is a primary object of the present invention to provide a wick structure for a combination thermal module. The wick structure enables a working fluid to flow from a heat pipe back to a vapor chamber more efficiently.

To achieve the above and other objects, the wick structure for combination thermal module according to the present invention includes an annular wick structure.

The annular wick structure has two opposing end surfaces, one of which is an upper end surface and the other is a lower end surface, an axial passage, and at least one radially passage. The axial passage axially extends through the annular wick structure from the upper end surface to the lower end surface to communicate the two end surfaces with each other. The radial passage radially extends through the annular wick structure from the axial passage to an outer peripheral surface of the annular wick structure.

To achieve the above and other objects, the present invention also provides a thermal module, which includes a vapor chamber, at least one annular wick structure, and at least one heat pipe.

The vapor chamber internally defines an airtight chamber filled with a working fluid. An inner wall surface of the vapor chamber located corresponding to a lower side of the airtight chamber is provided with a first wick structure to form a vaporizing zone in the vapor chamber. At least one through hole is formed on the vapor chamber to extend through one side wall, preferably an upper side wall, of the vapor chamber to communicate the airtight chamber with a space outside the airtight chamber.

The annular wick structure is provided in the airtight chamber at a position corresponding to the through hole on the vapor chamber. The annular wick structure has two opposing end surfaces, one of which is an upper end surface and the other is a lower end surface, and is provided with an axial passage and at least one radial passage. The axial passage axially extends through the annular wick structure from the upper to the lower end surface; and the radial passage radially extends through the annular wick structure from the axial passage to an outer peripheral surface of the annular wick structure, such that the axial and the radial passage are communicable with each other.

The heat pipe has two opposing ends, one of which is a closed end and the other is an open end, and internally defines a heat pipe chamber extended between the closed end and the open end of the heat pipe. The heat pipe chamber is provided on its inner wall surface with a second wick structure. The open end of the heat pipe is correspondingly inserted into the through hole to enter the airtight chamber of the vapor chamber and is directly pressed against and supported on the upper end surface of the annular wick structure.

The annular wick structure provides axial supporting and locating of the open end of the heat pipe that is inserted into the airtight chamber to therefore enhance an overall structural strength of the combination thermal module. The axial and the radial passage of the annular wick structure enable the vapor-phase working fluid to flow quickly to the heat pipe chamber and shorten the path and the time for the liquid-phase working fluid to flow from the heat pipe back to the vapor chamber, and accordingly, upgrade the overall two-phase heat exchange efficiency of the combination thermal module.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
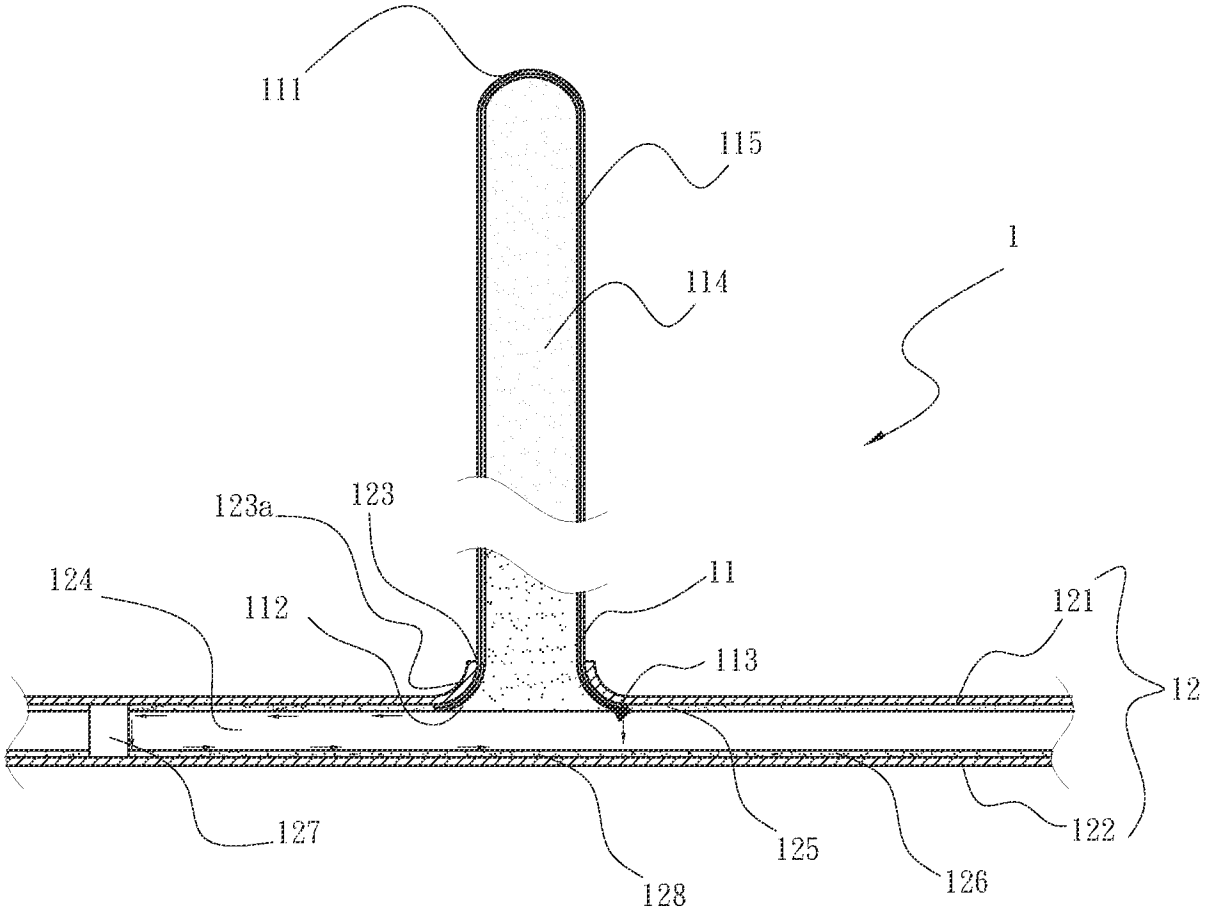
(PRIOR ART) Fig. 1
FIG. 1 is a cross-sectional view of a conventional three-dimensional (3D) vapor chamber structure.

The present invention will now be described with some preferred embodiments thereof. For the purpose of easy to understand, elements that are the same in the preferred embodiments are denoted by the same reference numerals.

Figure 2:
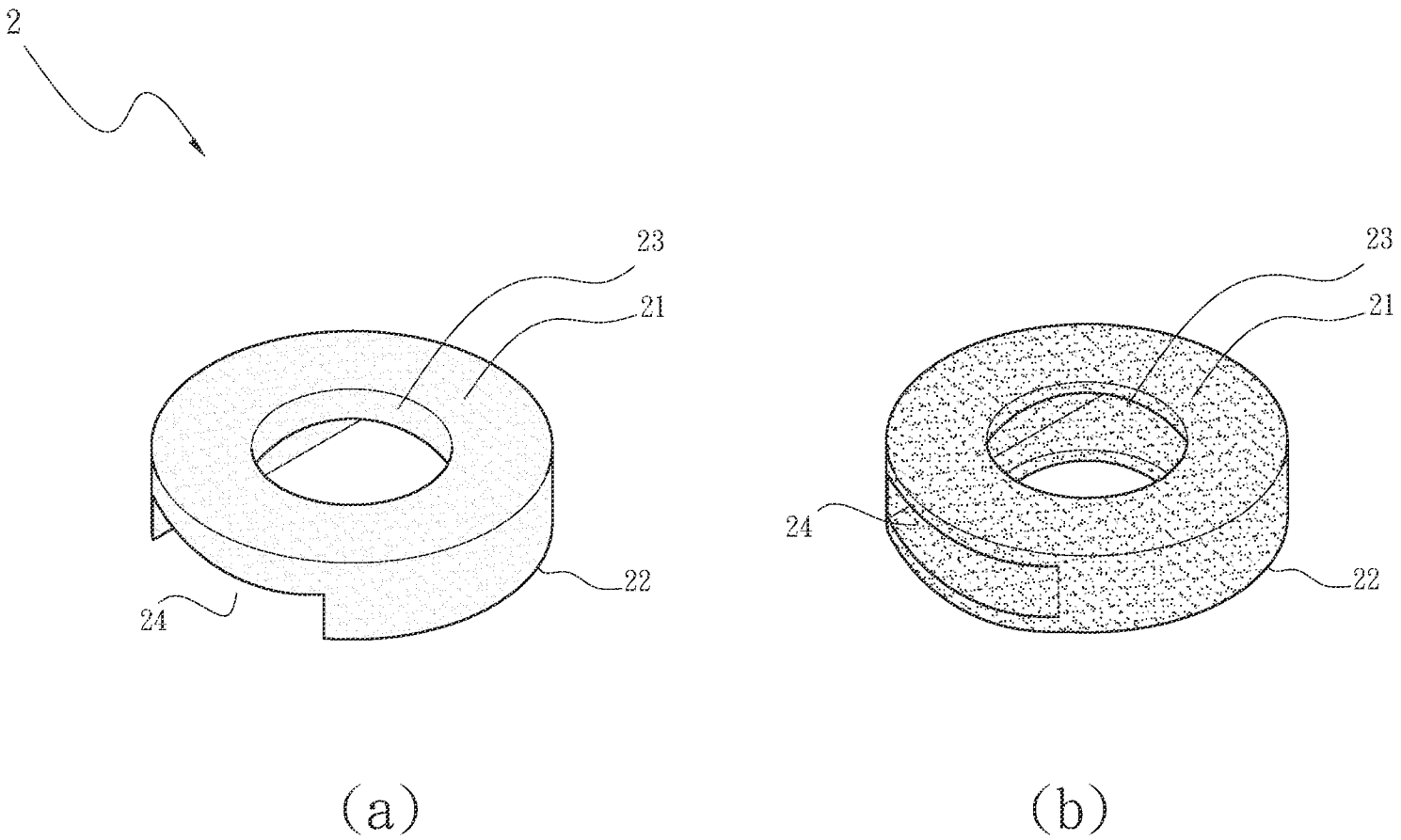
FIGS. 2*a* and 2*b* are perspective views showing two embodiments of a wick structure for combination thermal module according to the present invention.

Please refer to FIGS. 2*a* and 2*b*, which are perspective views of two embodiments of the wick structure for combination thermal module according to the present invention. As shown, the wick structure for combination thermal module includes an annular wick structure 2.

The annular wick structure 2 has two opposite end surfaces, one of which is an upper end surface 21 and the other is a lower end surface 22, an axial passage 23, and at least one radial passage 24. The axial passage 23 axially extends through the annular wick structure 2 and is communicable with the upper end surface 21 and the lower end surface 22. The at least one radial passage 24 is provided an outer surface of the annular wick structure 2 to extend in a radial direction and is communicable with the axial passage 23.

The radial passage 24 on the annular wick structure 2 can be formed on one or both of the upper end surface 21 and the lower end surface 22 and is communicable with the axial passage 23. In the illustrated preferred embodiment, the radial passage 24 is formed on the lower end surface 22, as shown in FIG. 2*a*. Alternatively, the radial passage 24 can be formed on the annular wick structure 2 between the upper and the lower end surface 21, 22, as shown in FIG. 2*b*. It is understood the above arrangements of the radial passage 24 on the annular wick structure 2 are only illustrative and not intend to limit the present invention in any way.

The annular wick structure 2 can be a solid or a porous structure. In the illustrated preferred embodiment, the annular wick structure 2 is a porous structure that provides good capillary force to facilitate good flow-back of a working fluid in the combination thermal module with the aid of the wick structure.

Figure 3:
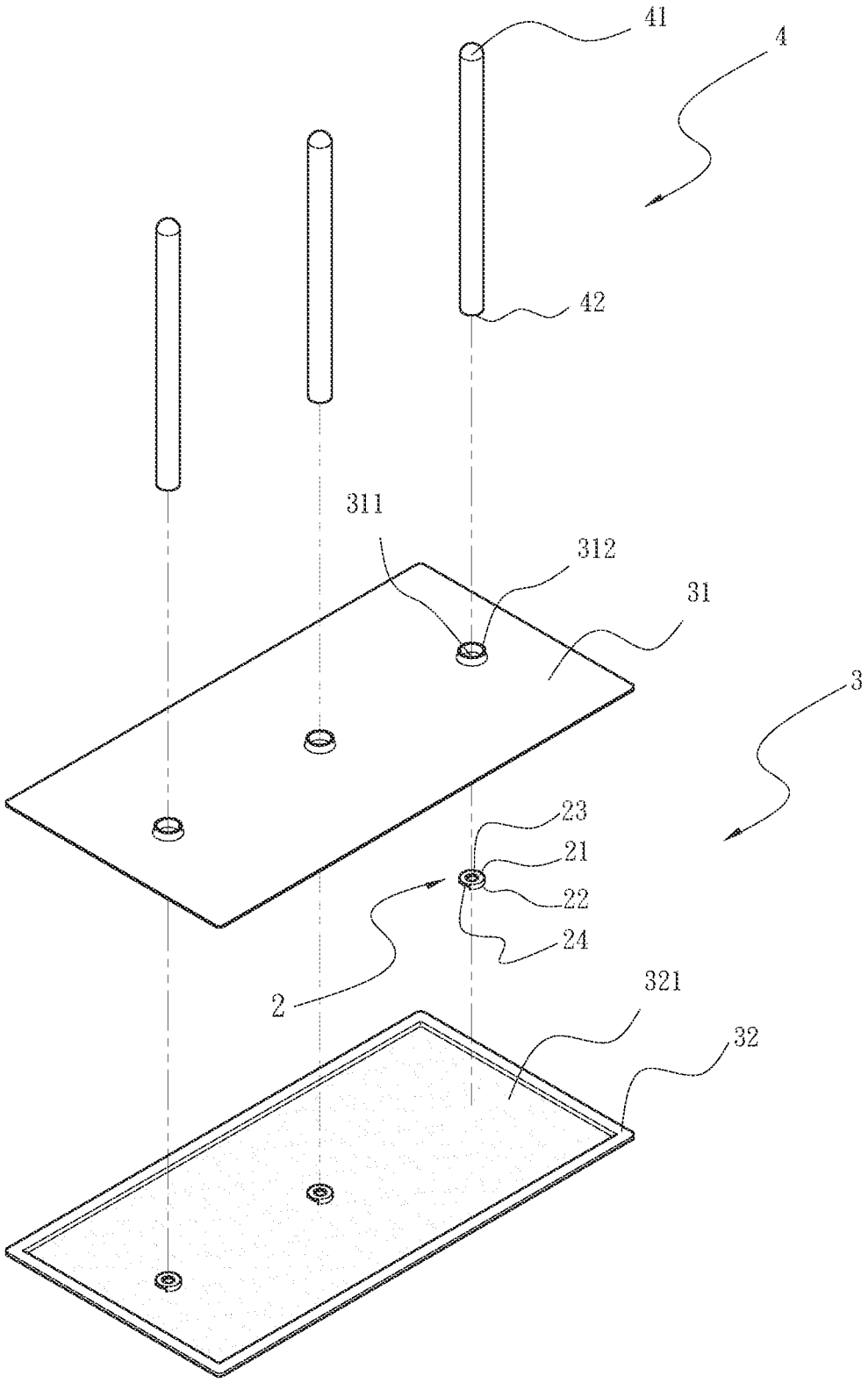
FIG. 3 is an exploded perspective view of a combination thermal module according to a preferred embodiment of the present invention.
Figure 4:
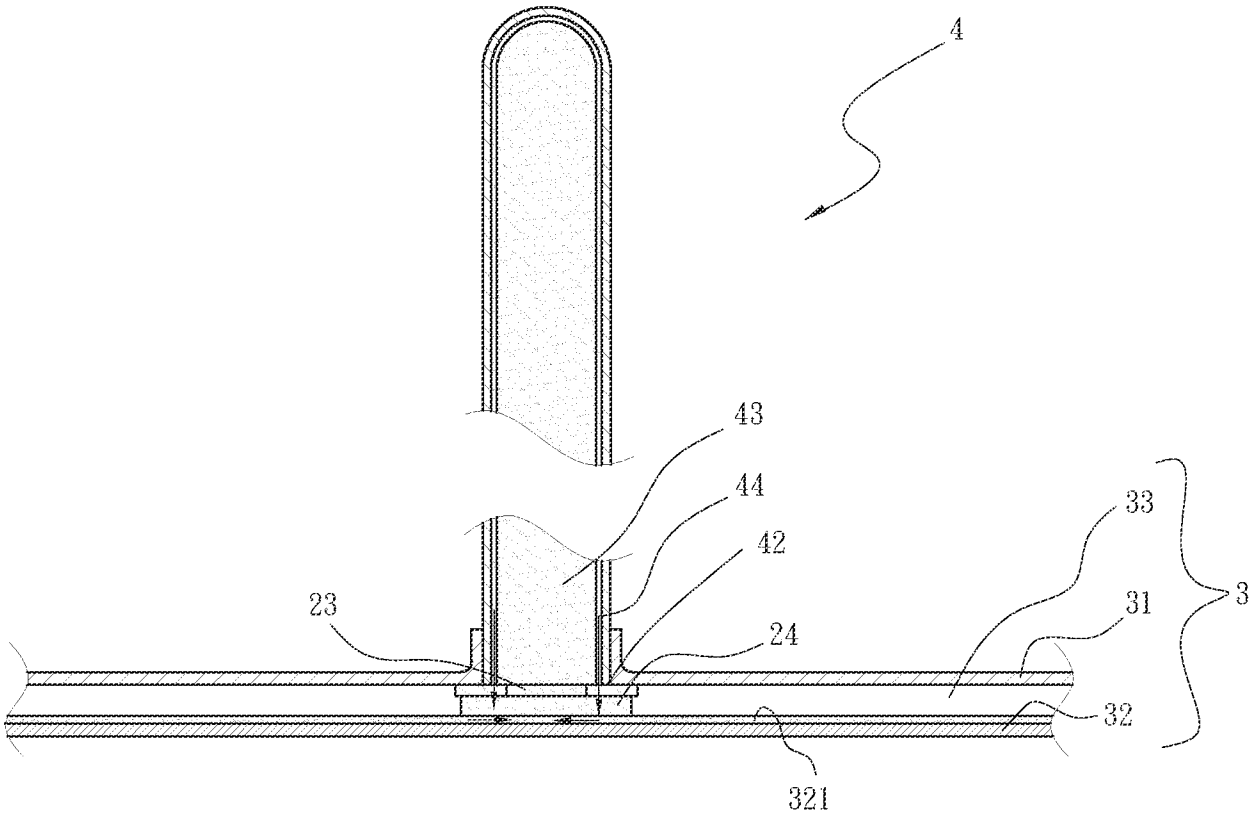
FIG. 4 is an assembled cross-sectional view of the combination thermal module of FIG. 3.
Figure 5:
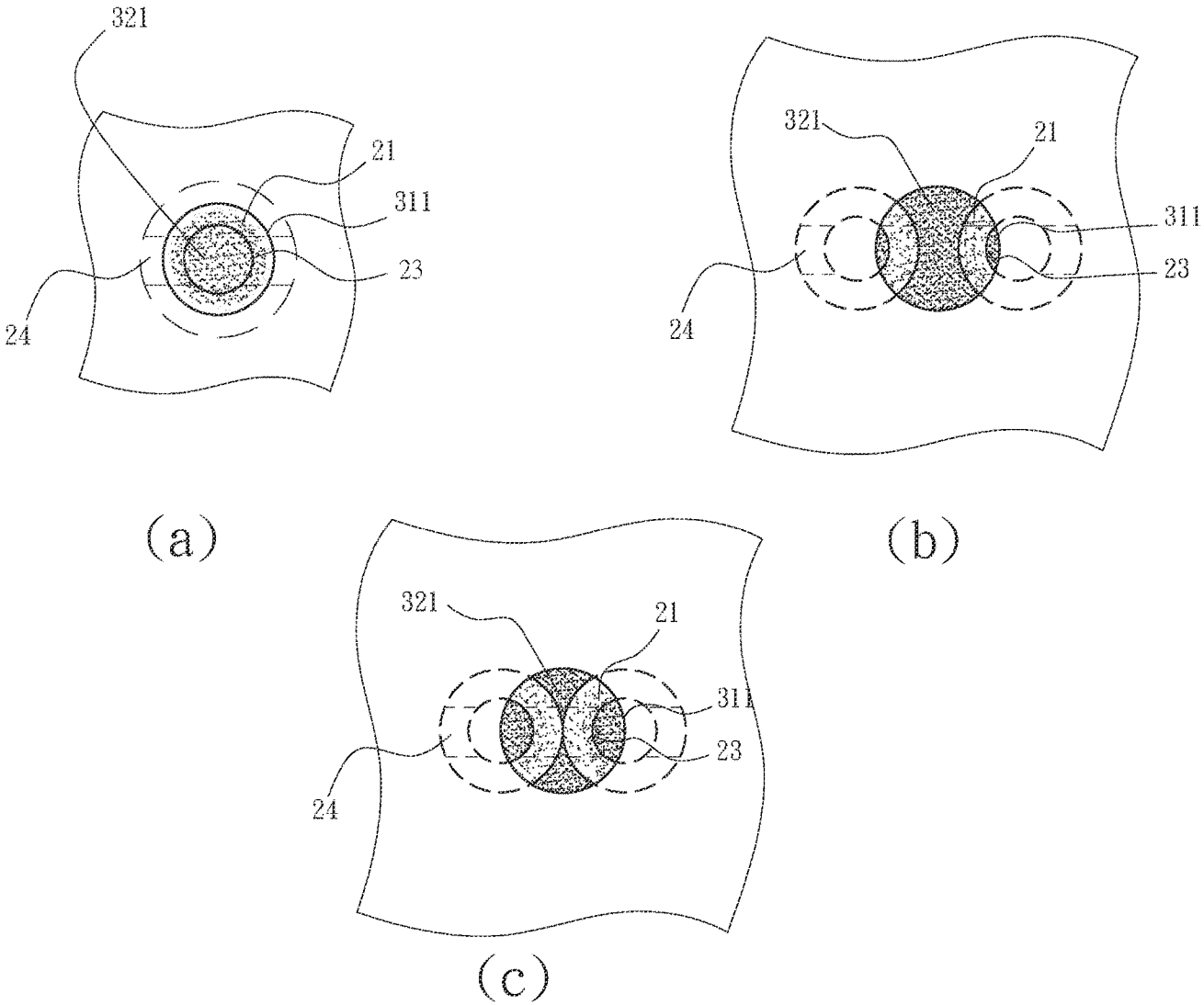
FIG. 5*a* is a top view of the combination thermal module of FIG. 2.
FIG. 5*b* is a top view of a first variant of the combination thermal module of FIG. 2.
FIG. 5*c* is a top view of a second variant of the combination thermal module of FIG. 2.

Please refer to FIGS. 3 and 4, which are exploded perspective view and assembled sectional view, respectively, of a first embodiment of the combination thermal module according to the present invention; and to FIGS. 5*a* to 5*c*, which are top views of different variants of the combination thermal module of the present invention. As shown, the combination thermal module of the present invention includes a vapor chamber 3, at least one annular wick structure 2, and at least one heat pipe 4.

The vapor chamber 3 includes an upper plate member 31 and a lower plate member 32, which are closed to each other to define an airtight chamber 33 between them. The airtight chamber 33 is filled with a working fluid (not shown). The upper plate member 31 of the vapor chamber 3 is provided with at least one through hole 311 that extends through the upper plate member 31 in a thickness direction thereof to communicate with the airtight chamber 33. Each through hole 311 on the vapor chamber 3 includes an outward and upward protruded flange 312 formed around a rim of the through hole 311. With the through hole 311, the airtight chamber 33 is communicable with an outer side of the vapor chamber 3 or with other external elements. In the preferred embodiment, the heat pipe 4 is inserted into the through hole 311 to enter the airtight chamber 33.

An inner side of the lower plate member 32 facing toward the airtight chamber 33 is a vaporizing zone of the vapor chamber 3 and has the first wick structure 321 and the annular wick structure 2 provided thereon. Since the structure of the annular wick structure 2 in the vapor chamber 3 has been described above with reference to FIGS. 2*a* and 2*b*, it is not repeatedly described herein.

Please refer to FIG. 5*a*. In the case one single annular wick structure 2 is provided corresponding to one through hole 311, the annular wick structure 2 can be placed with its axial passage 23 being concentric or eccentric with the through hole 311. Further, the axial passage 23 of the annular wick structure 2 has a diametric size equal to or smaller than a hole size of the through hole 311, and the annular wick structure 2 has an outer diameter larger than the hole size of the through hole 311. With these arrangements, portions or areas of the upper end surface 21 of the annular wick structure 2 extended between a rim of the axial passage 23 and the through hole 311 may serve to support the heat pipe 4 that is perpendicularly inserted into the through hole 311.

Please refer to FIGS. 5*b* and 5*c*. In the case two or more annular wick structures 2 are placed corresponding to one through hole 311, the annular wick structures 2 may be placed to space from one another, as shown in FIG. 5*b*, or be placed to be tangential to one another, as shown in FIG. 5*c*. In the above two cases, portions or areas of the upper end surfaces 21 of the annular wick structures 2 that overlap the through hole 311 may serve to support the heat pipe 4 that is perpendicularly inserted into the through hole 311.

The heat pipe 4 has two ends, one of which is a closed end 41 and the other is an open end 42, and internally defines a heat pipe chamber 43 extending between the closed end 41 and the open end 42. The heat pipe chamber 43 is provided on its entire inner wall surface with a second wick structure 44. The open end 42 of the heat pipe 4 is correspondingly inserted into the through hole 311 formed on the upper plate member 31 of the vapor chamber 3 to enter the airtight chamber 33 defined in the vapor chamber 3, such that the heat pipe 4 is joined to the vapor chamber 3. When the heat pipe 4 and the vapor chamber 3 are in an assembled state, the heat pipe chamber 43 and the airtight chamber 33 are communicable with each other.

The open end 42 of the heat pipe 4 is in contact with the upper end surface 21 of the annular wick structure 2. Therefore, the open end 42 of the heat pipe 4 extended into the airtight chamber 33 is axially supported on the upper end surface 21 of the annular wick structure 2. That is, the open end 42 of the heat pipe 4 is axially interfered by the annular wick structure 2, such that the heat pipe 4 can no longer axially move deeper into the airtight chamber 33 in the vapor chamber 3. It is the annular wick structure 2 that provides direct axial propping, locating, and supporting to the heat pipe 4 joined to the vapor chamber 3 and gives the joined heat pipe 4 and vapor chamber 3 a largely enhanced structural strength.

An inner side of the upper plate member 31 of the vapor chamber 3 that faces toward the airtight chamber 33 is provided with a third wick structure (not shown), which is so spread that it is in contact with the upper end surface 21 of the annular wick structure 2. Therefore, the working fluid condensed in the heat pipe chamber 43 is allowed to diffuse directly and quickly to the annular wick structure 2 via the third wick structure and to flow back to the vaporizing zone of the vapor chamber 3.

The first wick structure 311, the second wick structure 44, and the third wick structure (not numbered) may be formed of a sintered powder material, a woven mesh, a grid structure, or a fibrous structure. Further, the first wick structure 311, the second wick structure 44, and the third wick structure can be formed of the same or different wick structures.

The working fluid vaporized in the airtight chamber 33 of the vapor chamber 3 is allowed to diffuse directly to the heat pipe chamber 43 in the heat pipe 4, so that heat carried by the vaporized working fluid is dissipated into surrounding air at a location remote from the vapor chamber 3. Since the annular wick structure 2 is located correspondingly to the open end 42 of the heat pipe 4, the working fluid condensed in the heat pipe chamber 43 can be directly guided by the annular wick structure 2 to flow back to the first wick structure 321 provided in the vaporizing zone in the vapor chamber 3. With this arrangement, the path and the time for the condensed working fluid to flow from the heat pipe 4 back to the vaporizing zone are largely shortened, enabling the working fluid to flow back faster and allowing continuous and stable two-phase heat exchange of the working fluid in the vapor chamber 3 to avoid the occurrence of dry burning in the vapor chamber 3.

The working fluid vaporized in the airtight chamber 33 of the vapor chamber 3 can diffuse into the heat pipe chamber 43 via the radial passage 24 formed on the annular wick structure 2. With the radial passage 24, the vaporized working fluid can diffuse into the heat pipe chamber 43 without being hindered. That is, the diffusion of the vaporized working fluid from the vapor chamber 3 to the heat pipe 4 and the flow-back of the condensed working fluid from the heat pipe 4 to the vapor chamber 3 can be achieved smoothly in both vertical and horizontal directions via the axial passage 23 and the radial passage 24 of the annular wick structure 2.

The provision of the annular wick structure 2 not only enables good control of the depth by which the heat pipe 4 can be axially inserted into the airtight chamber 33 from an outer side of the vapor chamber 3, but also provides good axial supporting and locating of the heat pipe 4 and increases the structural strength of the combined heat pipe 4 and vapor chamber 3.

By providing the annular wick structure 2, it is able to largely shorten the path and the time for the condensed working fluid in the heat pipe chamber 43 to flow from the heat pipe 4 through the annular wick structure 2 back to the first wick structure 321 in the vaporizing zone of the vapor chamber 3. Therefore, the two-phase heat exchange in between the heat pipe 4 and the vapor chamber 3 can occur continuously to avoid the situation of dry burning in the vaporizing zone of the vapor chamber 3.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A combination thermal module comprising:

a vapor chamber internally defining an airtight chamber filled with a working fluid; an inner side surface of the vapor chamber located corresponding to a lower wall of the airtight chamber being provided with a first wick structure; and the vapor chamber being provided on one side with at least one through hole, which is communicable with the airtight chamber;

at least one annular wick structure being provided in the airtight chamber at a position corresponding to the through hole; the annular wick structure having two opposing end surfaces, one of which is an upper end surface and the other is a lower end surface, and being provided with an axial passage and at least one radial passage; the axial passage axially extending through the annular wick structure from the upper to the lower end surface, such that the upper and the lower end surfaces are communicable with each other; and the radial passage radially extending through the annular wick structure from the axial passage to an outer peripheral surface of the annular wick structure, such that the axial and the radial passages are communicable with each other; and at least one heat pipe internally defining a heat pipe chamber extended between a closed end and an open end of the heat pipe; the open end of the heat pipe being correspondingly inserted into the through hole to enter the airtight chamber of the vapor chamber and be directly pressed against and supported on the upper end surface of the annular wick structure; and wherein the annular wick structure axially props, locates and supports the open end of the heat pipe inserted into the airtight chamber, enabling the combined heat pipe and vapor chamber to have an enhanced overall structural strength, guiding the working fluid condensed in the heat pipe to flow back to the first wick structure, and accordingly, shortening the path and time for the working fluid to flow from the heat pipe back to the vapor chamber and upgrading the two-phase heat exchange efficiency of the vapor chamber.

2. The combination thermal module as claimed in claim 1, wherein the through hole on the vapor chamber includes a flange outward and upward extending from a rim of the through hole.

3. The combination thermal module as claimed in claim 2, wherein an inner side of the vapor chamber corresponding to an upper wall of the airtight chamber is provided with a third wick structure, which is so spread that it is in contact with the annular wick structure.

4. The combination thermal module as claimed in claim 1, wherein the heat pipe is provided on its inner wall surface with a second wick structure, and the first and the second wick structure are in contact with the lower and the upper end of the annular wick structure, respectively.

5. The combination thermal module as claimed in claim 4, wherein the first and the second wick structure are formed of a sintered powder material.

6. The combination thermal module as claimed in claim 5, wherein the annular wick structure is a porous structure.

7. The combination thermal module as claimed in claim 1, wherein the annular wick structure is located concentric with the through hole of the vapor chamber and wherein the axial passage of the annular wick structure has a diameter less than a hole size of the through hole and wherein an outer diameter of the annular wick structure is greater than the hole size of the through hole.

8. The combination thermal module as claimed in claim 7, wherein the annular wick structure is a porous structure.

9. The combination thermal module as claimed in claim 1, wherein there is a plurality of annular wick structures located corresponding to the same one through hole, and the annular wick structures being spaced from one another while overlapping the through hole.

10. The combination thermal module as claimed in claim 9, wherein the annular wick structure is a porous structure.

11. The combination thermal module as claimed in claim 1, wherein the annular wick structure is a porous structure.

* * * * *